US009905211B1

(12) United States Patent
Lee

(10) Patent No.: US 9,905,211 B1
(45) Date of Patent: Feb. 27, 2018

(54) GUITAR EFFECTOR LOOP AND MULTI-TYPE GUITAR EFFECTOR USING THE SAME

(71) Applicant: Seung Jae Lee, Seoul (KR)

(72) Inventor: Seung Jae Lee, Seoul (KR)

( * ) Notice: Subject to any disclaimer, the term of this patent is extended or adjusted under 35 U.S.C. 154(b) by 0 days.

(21) Appl. No.: 15/718,169

(22) Filed: Sep. 28, 2017

(30) Foreign Application Priority Data

Sep. 28, 2016 (KR) ..... 10-2016-0124685

(51) Int. Cl.
*G10H 1/00* (2006.01)
*G10H 1/34* (2006.01)

(52) U.S. Cl.
CPC ..... *G10H 1/348* (2013.01); *G10H 2210/155* (2013.01)

(58) Field of Classification Search
CPC ..... G10H 1/02; G10H 1/0008; G10H 1/34; G10H 2210/155; G10H 2220/096; G10H 1/348
USPC ..... 84/626, 615, 746
See application file for complete search history.

(56) References Cited

U.S. PATENT DOCUMENTS 6,215,055 B1 * 4/2001 Saravis ..... G10H 1/348 84/422.1
7,525,038 B2 * 4/2009 Yamada ..... G10H 1/0091 84/622
9,263,014 B2 * 2/2016 Brandt ..... G10H 1/0091
9,595,248 B1 * 3/2017 Classe ..... G10H 1/348
9,633,640 B1 * 4/2017 Lee ..... G10H 1/348
9,704,462 B2 * 7/2017 Burmas ..... G10G 7/00
9,728,172 B1 * 8/2017 Perez ..... G10H 1/18
2009/0183625 A1 * 7/2009 Sanders ..... G10H 1/0091 84/626
2011/0271821 A1 * 11/2011 McKinney ..... G10H 1/348 84/746
2013/0327201 A1 * 12/2013 Urry ..... G10H 1/06 84/626
2014/0090546 A1 * 4/2014 Ceccolini ..... G10H 1/02 84/626
2015/0161978 A1 * 6/2015 Packouz ..... G10H 1/40 84/746
2016/0019877 A1 * 1/2016 Remignanti ..... G10H 1/0066 84/645
2016/0275928 A1 * 9/2016 Lee ..... G10H 1/0091
2016/0293151 A1 * 10/2016 Mayo ..... G10H 1/0058
2017/0025107 A1 * 1/2017 Packouz ..... G10H 1/348
(Continued)

*Primary Examiner* — Jeffrey Donels
(74) *Attorney, Agent, or Firm* — Kile Park Reed & Houtteman PLLC

(57) ABSTRACT

Provided is a guitar effector loop in which a plurality of foot switches (600) are installed in a body so that the plurality of foot switches (600) are connected to a guitar (a), an amplifier (b), and a plurality of compactors (500), and various combinations of the compactors (500) are obtained. In a state in which the No. 1 alternative switch (611) and the No. 2 alternative switch (612) are turned off, or the No. 2 alternative switch (612) is turned on, when the No. 1 alternative switch (611) is turned on, the compactor (500) set by the No. 1 alternative switch (611) is turned on, and the compactor (504) set by only the No. 2 alternative switch (612) is turned off. Thus, the number of combinations of the guitar effectors may increase without increasing the number of switches.

16 Claims, 22 Drawing Sheets

(56) References Cited

U.S. PATENT DOCUMENTS

| | | | | |
|---|---|---|---|---|
| 2017/0025108 | A1* | 1/2017 | Packouz | G10H 1/42 |
| 2017/0316766 | A1* | 11/2017 | Perez | G10H 1/18 |

* cited by examiner

FIG. 13

| Bank | A | B | C | D |
|---|---|---|---|---|
| 10 | 1,2,3 | 1,2,4 | 3,4 | 4 |
| 11 | | | | |
| ⋮ | | | | |
| 99 | | | | |

FIG. 15

| Bank | A | B | C | D |
|---|---|---|---|---|
| 10 | 1,2,3 | 1,2,4 | ③ | ④ |
| 11 | | | | |
| ⋮ | | | | |
| 99 | | | | |

FIG. 17

| Bank | A | B | C | D |
|---|---|---|---|---|
| 10 | 1,2,3 | 1,2,4 | ③ | ④ |
| 11 | 2,3 | 1,4 | ③ | ④ |
| ⋮ | | | | |
| 99 | | | | |

GUITAR EFFECTOR LOOP AND MULTI-TYPE GUITAR EFFECTOR USING THE SAME

CROSS-REFERENCE TO RELATED APPLICATIONS

This U.S. non-provisional patent application claims priority under 35 U.S.C. § 119 of Korean Patent Application No. 10-2016-0124685, filed on Sep. 28, 2016, the entire contents of which are hereby incorporated by reference.

BACKGROUND

The present invention relates to a musical instrument, and more particularly, to an effector of a guitar.

Various kinds of effectors are used to distort a tone of an electronic guitar.

Such effectors may be classified into an analogue type and a digital type. The latter has an advantage in that use thereof is convenient but has a disadvantage in that a sound quality thereof is low. Thus, in recent years, an effector using an analogue scheme tends to be mainly used.

The effector using an analogue scheme, which refers to a compactor, includes: an input unit 3 that receives an input signal from a guitar a or another guitar effector; an output unit 4 that transmits an output signal to an amplifier b or another guitar effector; and a foot switch 5 that controls a turn-on/off state of the corresponding compactor (see FIGS. 1 to 10).

Since a player adjusts a turn-on/off state thereof during performance through the foot switch 5, the effector refers to a guitar pedal.

For example, in case of backing for expressing rock music or solo performance, effectors such as an overdrive effector and a distortion effector are required (see FIGS. 1 and 2). In case of arpeggios or strokes, to obtain a clean tone, effectors such as a reverb effector, a delay effector and a chorus effector are required (see FIGS. 3 to 5). When a special effect is required, effectors such as a phase effector, a wah effector and an octave effector are required (see FIGS. 6 to 8), and in other cases, a compressor effector, an equalizer effector, or the like may be used (see FIGS. 9 and 10).

When playing a guitar, a player generally uses a plurality of tones in the same tune, and a combination of a plurality of compactors is required to obtain the respective tones.

For this, the plurality of compactors are previously connected to each other, and each of the compactors is turned on or off by the foot switch during performance to realize various combinations, thereby obtaining a desired tone (since the player does not use his or her hands due to the guitar playing).

When some of the compactors connected to each other are turned on, and the others of the compactors are turned off, the compactors that are turned off are bypassed, and only the compactors that are turned on are combined with each other to obtain a distorted tone.

Since it is difficult to manipulate the foot switches of the plurality of compactors during the performance so as to obtain a necessary tone, a guitar effector loop (a programmable loop) 10 in which a plurality of switches 11, 12, 13, and 14 are installed to allow a user to set a separate combination of the compactors for respective switches has been developed (see FIG. 11).

Since the plurality of switches 11, 12, 13, and 14 are controlled to alternatively act, when one switch is turned on (pushed), other switches are automatically turned off.

For example, a case in which the Nos. 1, 2, and 3 effectors are set for the A switch 11, the Nos. 1, 2, and 4 effectors are set for the B switch 12, the Nos. 3 and 4 effectors are set for the C switch 13, and the No. 4 effector is set for the D switch 14, will be described as follows (see FIG. 12).

When the A switch 11 is turned on, the Nos. 1, 2, and 3 effectors are turned on, and the No. 4 effector is automatically turned off.

When the B switch 12 is turned on, the Nos. 1, 2, and 4 effectors are turned on, and the No. 3 effector is automatically turned off.

When the C switch 13 is turned on, the Nos. 3 and 4 effectors are turned on, and the Nos. 1 and 2 effectors are automatically turned off.

When the D switch 14 is turned on, the No. 4 effector is turned on, and the Nos. 1, 2, and 3 effectors are automatically turned off.

A unique number is set for each of the combinations and stored in a bank so that the unique numbers are selected and used as needed (see FIG. 13).

The above-described related art has the following limitations.

The types of guitar effectors are very various as described above, and thus, there are many kinds of combinations of the guitar effectors. As a result, in the guitar effector loop according to the related art, since the combinations of the guitar effectors are obtained by only the about four selected switches that are previously installed, the limitation is that the choice of combination is too narrow.

Although various combinations of guitar effectors are stored in the bank, since it is necessary to designate the unique number by hands so as to select each of the combinations, it is practically impossible to change the combination during the performance.

SUMMARY

The present invention has been made to solve the above limitations, and thus, an object of the present invention is to provide a guitar effector loop that is capable of increasing the number of combinations of guitar effectors without increasing the number of switches and a multi-type guitar effector using the same.

An embodiment of the present invention provides a guitar effector loop including foot switches (600) which are connected to a guitar (a), an amplifier (b), and a plurality of compactors (500) and set to turn on/off one or more compactors (500) of the plurality of compactors (500) according to setting of a control unit of a body, wherein the plurality of foot switches (600) are installed in the body so that various combinations of the plurality of compactors (500) are obtained, wherein the plurality of compactors (500) include a No. 1 compactor (501), a No. 2 compactor (502), and a No. 3 compactor (503), the plurality of foot switches (600) include a plurality of alternative switches (610) including a No. 1 alternative switch (611) and a No. 2 alternative switch (612) and an independent switch (620), the No. 1 alternative switch (611) is set to the plurality of compactors (500), the No. 2 alternative switch (612) is set to the plurality of compactors (500) so that combinations different from the combinations of the plurality of compactors (500), which are set by the No. 1 alternative switch (611), are obtained, the independent switch (620) is set to the No. 3 compactor (503), in a state in which the No. 1 alternative switch (611) and the No. 2 alternative switch (612) are turned off, or the No. 2 alternative switch (612) is turned on, when the No. 1 alternative switch (611) is turned on, the compactor (500) set by the No. 1 alternative switch (611) is turned on, and the compactor (504) set by only the No. 2 alternative switch (612) is turned off, in a state in which the No. 1 alternative switch (611) and the No. 2 alternative switch (612) are turned off, or the No. 1 alternative switch (611) is turned on, when the No. 2 alternative switch (612) is turned on, the compactor (500) set by the No. 2 alternative switch (612) is turned on, and the compactor (500) set by only the No. 1 alternative switch (611) is turned off, and In a state in which the No. 1 alternative switch (611) and the No. 2 alternative switch (612) are turned off, the No. 1 alternative switch (611) is turned on, or the No. 2 alternative switch (612) is turned on, when the No. 1 independent switch (621) is turned on, the No. 3 compactor (503) is turned on, and also, each of other compactors (500) of the plurality of compactors (500) is maintained in its original state.

When the independent switch (620) is turned off in the turn-on state of the independent switch (620), the No. 3 compactor (503) may be turned off, and each of other compactors (501, 502) of the plurality of compactors (500) may be maintained in its original state.

In case in which the No. 2 alternative switch (612) is not set to the No. 3 compactor (503), when the No. 2 alternative switch (612) is turned on in the turn-on state of the independent switch (620) and in the turn-off state of the No. 1 alternative switch (611) and the No. 2 alternative switch (612) or in the turn-on state of the No. 1 alternative switch (611), the No. 3 compactor (503) may be turned off.

The No. 1 alternative switch (611) may be set to the plurality of compactors (500) including the No. 1 compactor (501), and when the No. 1 alternative switch (611) is turned off in the turn-on state of the No. 1 alternative switch (611), only the No. 1 compactor (501) may be turned off, and the other compactor (500) set by the No. 1 alternative switch (611) may be maintained in the turn-on state.

When the No. 1 alternative switch (611) is turned on in the turn-off state of the No. 1 alternative switch (611), only the No. 1 compactor (501) may be turned on, and the other compactor (500) set by the No. 1 alternative switch (611) may be maintained in the turn-on state.

The No. 1 alternative switch (611) may be set to the plurality of compactors (500) not including the No. 1 compactor (501), and when the No. 1 alternative switch (611) is turned off in the turn-on state of the No. 1 alternative switch (611), the compactor (500) set by the No. 1 alternative switch (611) may be maintained in the turn-on state, and the No. 1 compactor (501) may be turned on.

When the No. 1 alternative switch (611) is turned on in the turn-off state of the No. 1 alternative switch (611), only the No. 1 compactor (501) may be turned off, and the other compactor (500) set by the No. 1 alternative switch (611) may be maintained in the turn-on state.

In case in which the No. 2 alternative switch (612) is not set to the No. 3 compactor (503), when the No. 2 alternative switch (612) is turned off in the turn-on state of the No. 2 alternative switch (612) and the independent switch (620), only the No. 3 compactor (503) may be turned off, and the other compactor (500) set by the No. 2 alternative switch (612) may be maintained in the turn-on.

In an embodiment of the inventive concept, a multi-type guitar effector, in which a plurality of guitar effector modules (100) are installed, wherein each of the guitar effector modules (100) includes a component circuit board (110) on which a circuit for an analogue type guitar effector is disposed; a module case (130) on which a variable resistor driving unit (131) for adjusting a sound by the circuit is mounted and in which the component circuit board (110) is installed; and a circuit connection unit (120) in which a circuit unit part (121), a circuit output part (122), and a circuit power supply part (123) with respect to the circuit are disposed and which is electrically connected to the component circuit board (110) and is installed outside the module case (130), includes: a body having a module mounting space (211) for mounting the plurality of guitar effector modules (100) therein; a plurality of opened parts (212) defined in a top surface of the body (210) having a shape corresponding to one or a plurality of module cases (130) so that the plurality of module cases (130) are installed; a plurality of body connection units (220) in which body input parts (221), body output parts (222), and body power supply parts (223) are disposed to be connected to the circuit input parts (121), the circuit output parts (122), and circuit power supply parts (123) of the plurality of circuit connection units (120), respectively; a body circuit board (230) which is connected to the plurality of body connection parts (220) and mounted on a body circuit mounting space (213) of the body (210) and in which a body circuit is disposed; an input terminal (201) disposed in the body (210) to receive an input signal of a guitar (a) and connected to the body circuit; an output terminal (202) disposed in the body (210) to transmit an output signal to an amplifier (b) and connected to the body circuit; and a plurality of foot switches (600) which is installed on the body (210) or a separate device connected to the body (210) so that various combinations of the guitar effector modules (110) are obtained by turning on/off one or the plurality of guitar effector modules (100) according to setting about the body circuit and which is connected to the body circuit, wherein the body circuit performs a control so that the input signal received through the input terminal (201) is distorted by sequentially passing through the plurality of component circuits to output the distorted signal through the output terminal (202), the plurality of guitar effector modules (100) include a No. 1 guitar effector module (101), a No. 2 guitar effector module (102), and a No. 3 guitar effector module (103), the plurality of foot switches (600) includes a plurality of alternative switches (610) including a No. 1 alternative switch (611) and a No. 2 alternative switch (612) and an independent switch (620), the No. 1 alternative switch (611) is set to the plurality of guitar effector modules (100), the No. 2 alternative switch (612) is set to the plurality of guitar effector modules (100) so that combinations different from the combinations of the plurality of guitar effector modules (100), which are set by the No. 1 alternative switch (611), are obtained, the independent switch (620) is set to the No. 3 guitar effector module (103), in a state in which the No. 1 alternative switch (611) and the No. 2 alternative switch (612) are turned off, or the No. 2 alternative switch (612) is turned on, when the No. 1 alternative switch (611) is turned on, the guitar effector module (100) set by the No. 1 alternative switch (611) is turned on, and the guitar effector module (100) set by only the No. 2 alternative switch (612) is turned off, in a state in which the No. 1 alternative switch (611) and the No. 2 alternative switch (612) are turned off, or the No. 1 alternative switch (611) is turned on, when the No. 2 alternative switch (612) is turned on, the guitar effector module (100) set by the No. 2 alternative switch (612) is turned on, and the guitar effector module (100) set by only the No. 1 alternative switch (611) is turned off, and in a state in which the No. 1 alternative switch (611) and the No. 2 alternative switch (612) are turned off, the No. 1 alternative switch (611) is turned on, or the No. 2 alternative switch (612) is turned on, when the No. 1 independent switch (621) is turned on, the No. 3 guitar effector module (103) is turned on, and each of other guitar effector modules (100) of the plurality of guitar effector modules (100) is maintained in its original state.

When the independent switch (620) is turned off in the turn-on state of the independent switch (620), the No. 3 compactor (503) may be turned off, and each of other guitar effector modules (101, 102) of the plurality of guitar effector modules (100) may be maintained in its original state.

In case in which the No. 2 alternative switch (612) is not set to the No. 3 guitar effector module (103), when the No. 2 alternative switch (612) is turned on in the turn-on state of the independent switch (620) and in the turn-off state of the No. 1 alternative switch (611) and the No. 2 alternative switch (612) or in the turn-on state of the No. 1 alternative switch (611), the No. 3 guitar effector module (103) may be turned off.

The No. 1 alternative switch (611) may be set to the plurality of guitar effector modules (100) including the No. 1 guitar effector module (101), and when the No. 1 alternative switch (611) is turned off in the turn-on state of the No. 1 alternative switch (611), only the No. 1 guitar effector module (101) may be turned off, and the other guitar effector module (100) set by the No. 1 alternative switch (611) may be maintained in the turn-on state.

When the No. 1 alternative switch (611) is turned on in the turn-off state of the No. 1 alternative switch (611), only the No. 1 guitar effector module (101) may be turned on, and the other guitar effector module (100) set by the No. 1 alternative switch (611) may be maintained in the turn-on state.

The No. 1 alternative switch (611) may be set to the plurality of guitar effector modules (100) not including the No. 1 guitar effector module (101), and when the No. 1 alternative switch (611) is turned off in the turn-on state of the No. 1 alternative switch (611), the guitar effector module (100) set by the No. 1 alternative switch (611) may be maintained in the turn-on state, and the No. 1 guitar effector module (101) may be turned on.

When the No. 1 alternative switch (611) is turned on in the turn-off state of the No. 1 alternative switch (611), only the No. 1 guitar effector module (101) may be turned off, and the other guitar effector module (100) set by the No. 1 alternative switch (611) may be maintained in the turn-on state.

In case in which the No. 2 alternative switch (612) is not set to the No. 3 guitar effector module (103), when the No. 2 alternative switch (612) is turned off in the turn-on state of the No. 2 alternative switch (612) and the independent switch (620), only the No. 3 guitar effector module (103) may be turned off, and the other guitar effector module (100) set by the No. 2 alternative switch (612) may be maintained in the turn-on.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings:

FIG. 13 is a view illustrating constituents of a bank of the guitar effector loop according to the related art;

An embodiment of the present invention will be described with reference to FIGS. 14 to 22.

FIG. 15 is a view illustrating constituents of a bank of the guitar effector loop according to an embodiment;

FIG. 17 is a view illustrating constituents of a bank of the guitar effector loop according to another embodiment;

DETAILED DESCRIPTION

Figure 1:
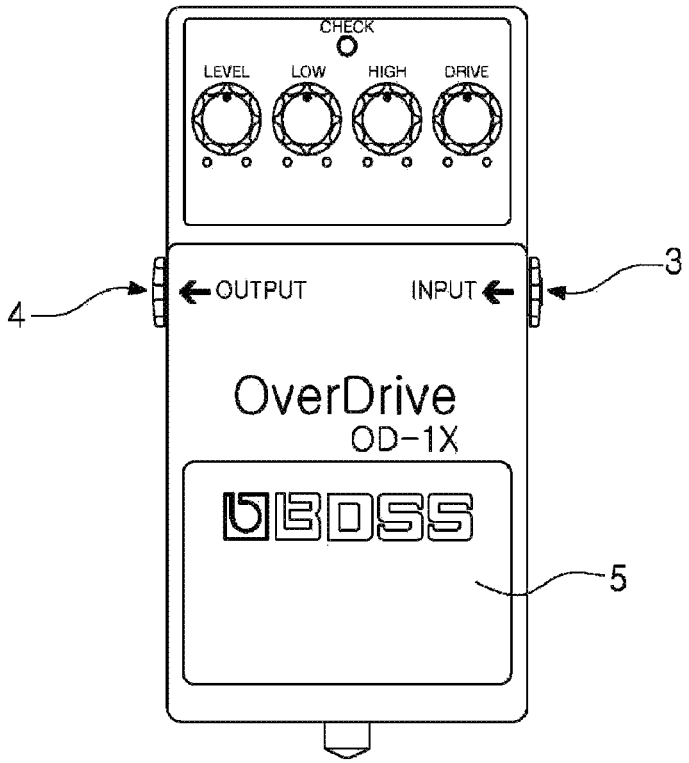
FIGS. 1 to 10 are plan views illustrating types of compactors according to the related art.
Figure 2:
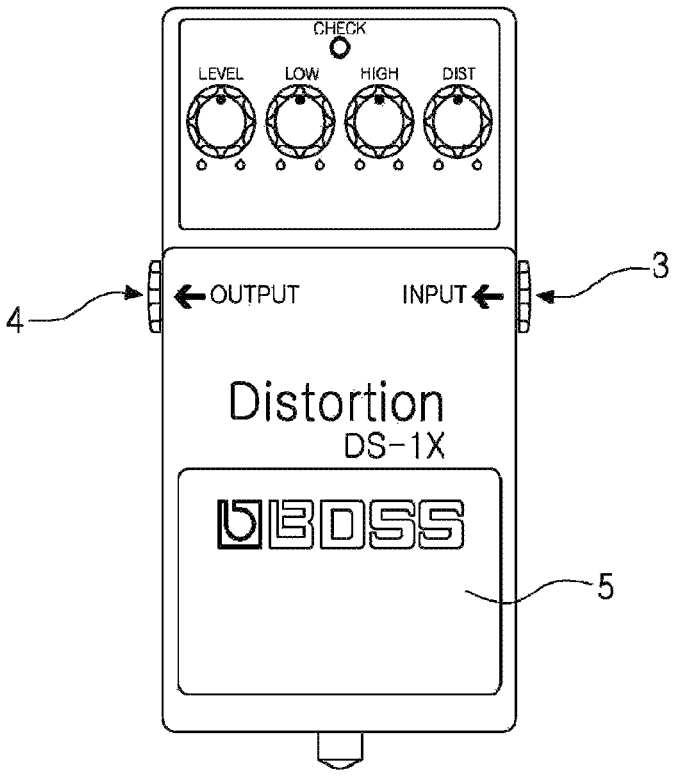
Figure 3:
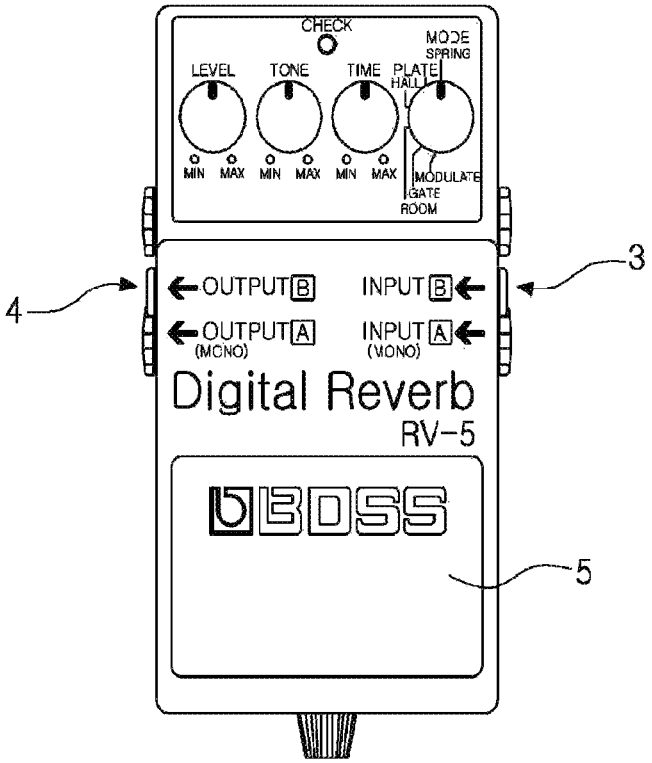
Figure 4:
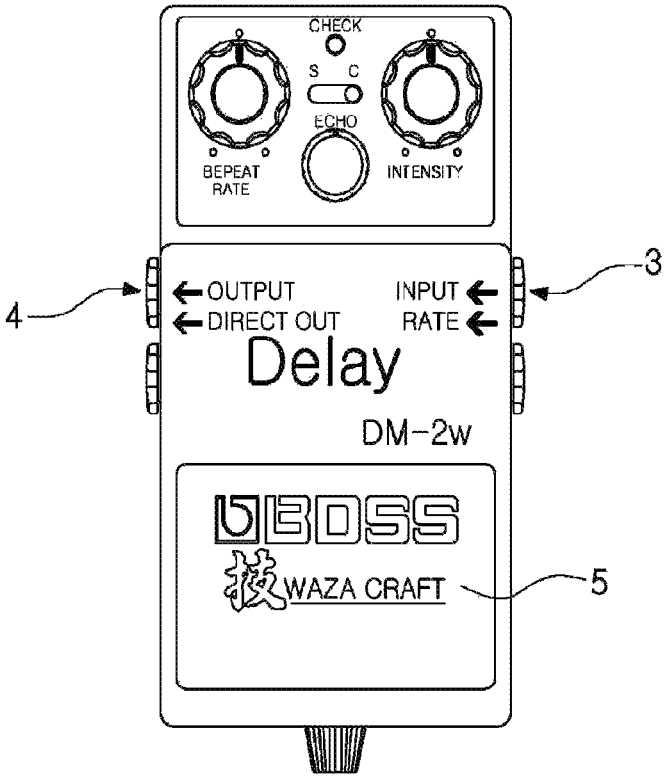
Figure 5:
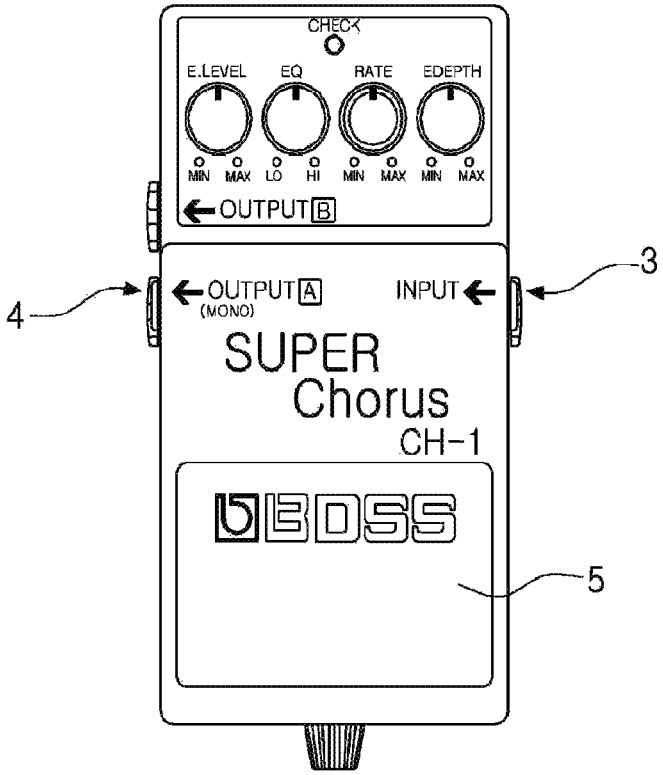
Figure 6:
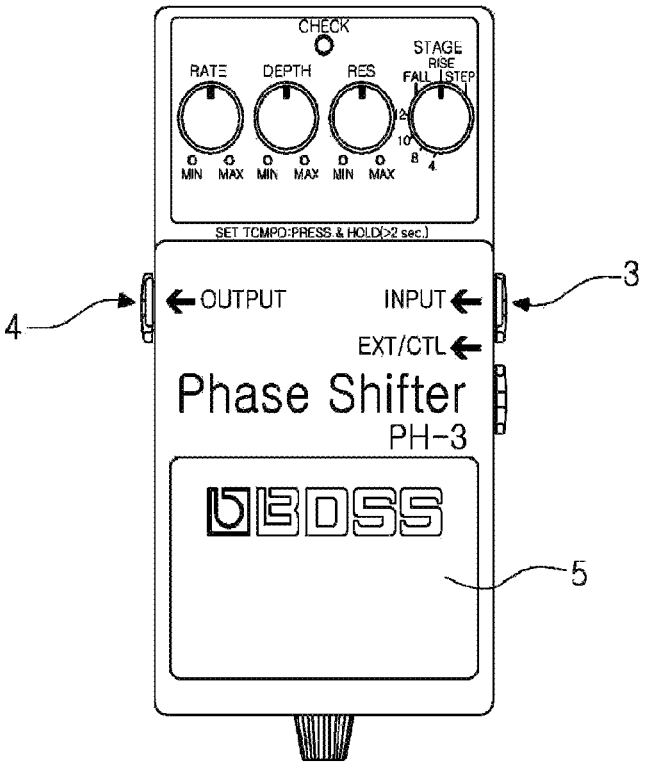
Figure 7:
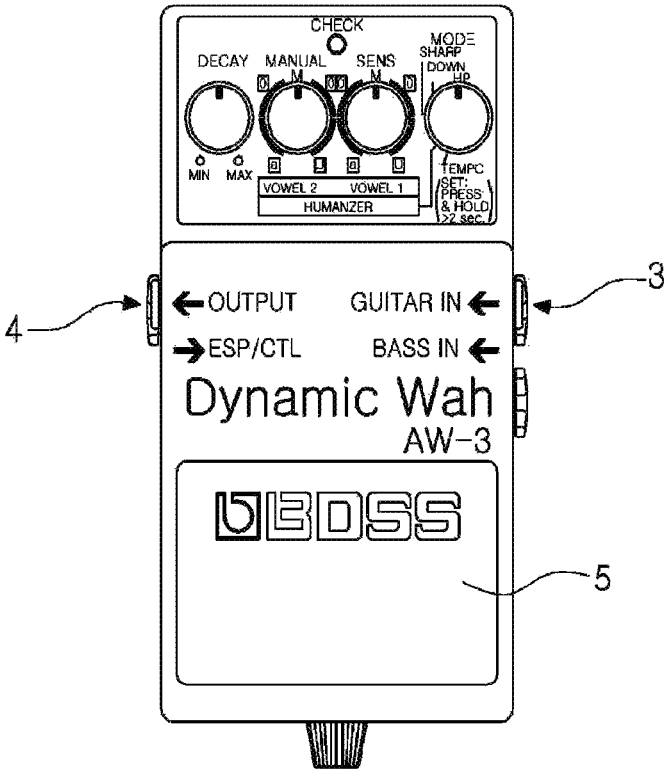
Figure 8:
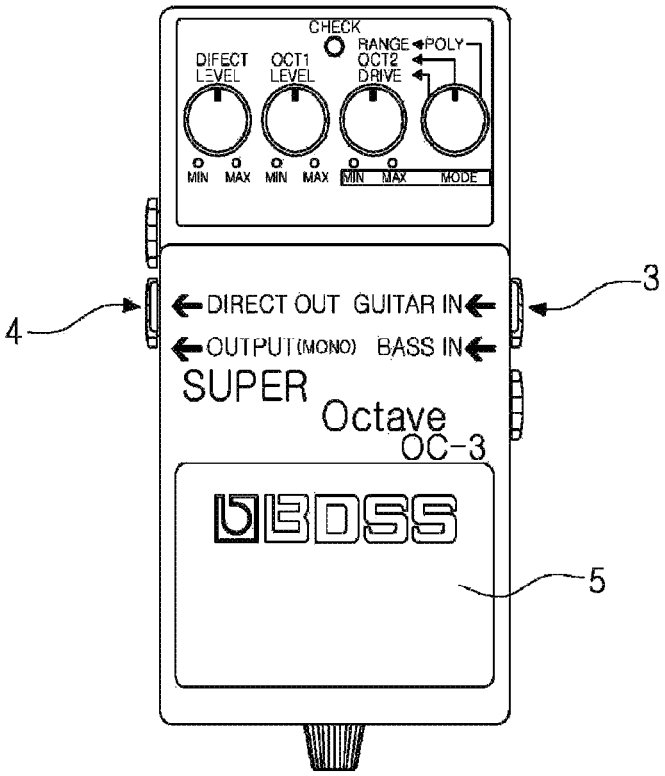
Figure 9:
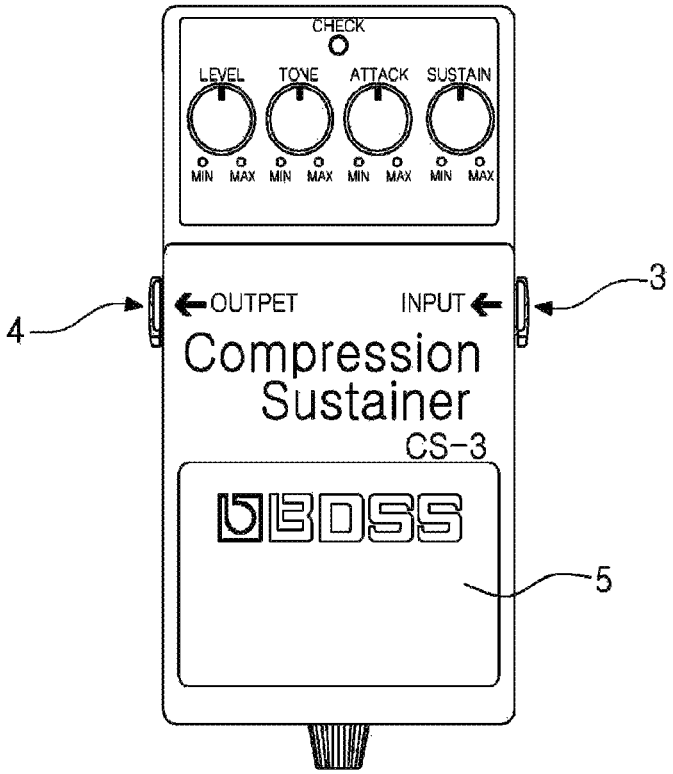
Figure 10:
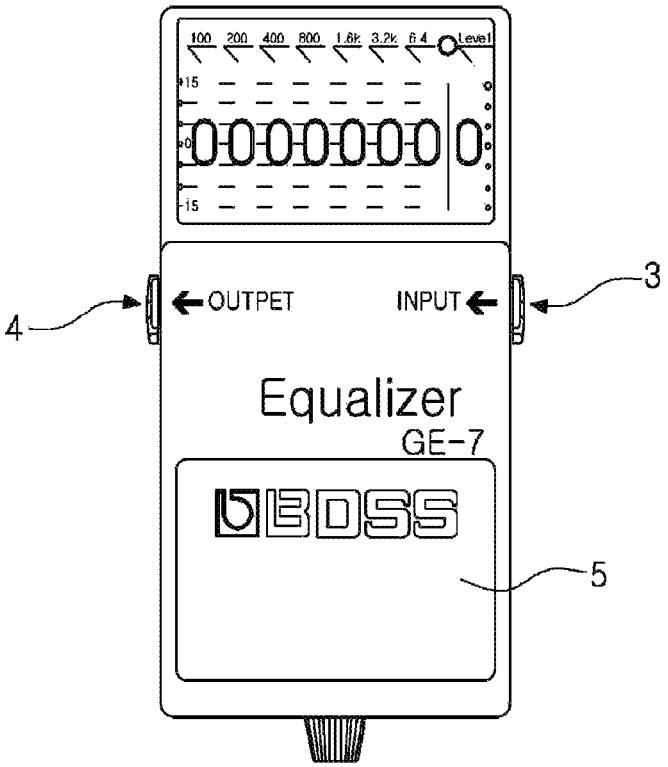
Figure 11:
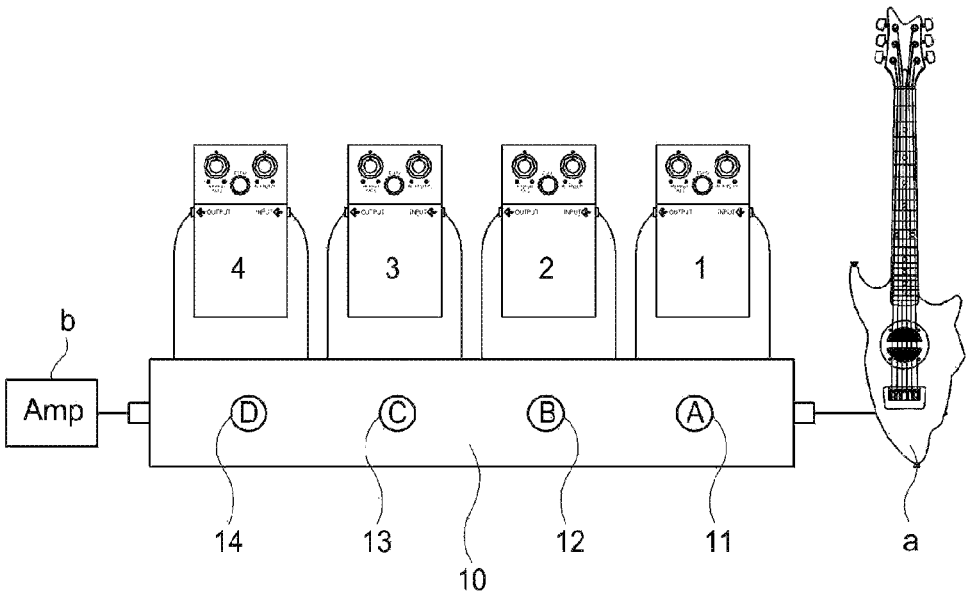
FIG. 11 is a view illustrating constituents of the guitar effector loop according to the related art.
Figure 12:
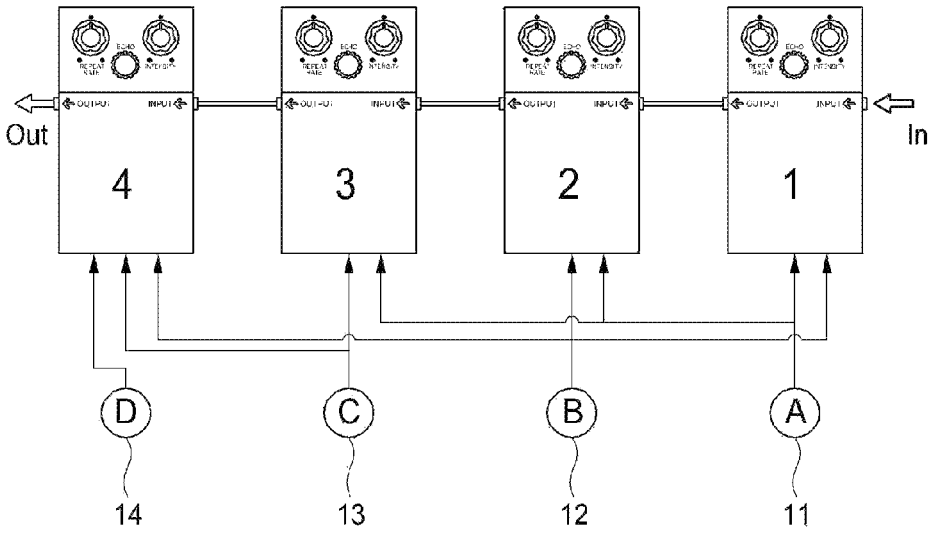
FIG. 12 is a conceptual view of the guitar effector loop according to the related art.

Hereinafter, exemplary embodiments of the present invention will be described in detail with reference to the accompanying drawings.

The present invention relates to a guitar effector loop. FIGS. 14 to 17 illustrate a guitar effector loop to which a compactor is connected according to an embodiment, and FIGS. 18 to 22 illustrate a multi-type guitar effector having a guitar effector loop function.

FIGS. 14 to 17 illustrate a guitar effector loop including foot switches 600 which are connected to a guitar a, an amplifier b, and a plurality of compactors 500 and set to turn on/off one or more compactors 500 of the plurality of compactors 500 according to setting of a control unit of a body. Here, the plurality of foot switches 600 are installed on the body so that various combinations of the plurality of compactors 500 are obtained.

Also, the plurality of compactors 500 include a No. 1 compactor 501, a No. 2 compactor 502, and a No. 3 compactor 503. The plurality of foot switches 600 include a plurality of alternative switches 610 including a No. 1 alternative switch 611 and a No. 2 alternative switch 612 and an independent switch 620. The No. 1 alternative switch 611 is set to the plurality of compactors 500, and the No. 2 alternative switch 612 is set to the plurality of compactors 500 so that combinations different from the combinations of the plurality of compactors 500, which are set by the No. 1 alternative switch 611, are obtained.

One or plurality of independent switches 620 may be set. Hereinafter, a case in which a No. 1 independent switch 621 is set to the No. 3 compactor 503, and a No. 2 independent switch 522 is set to the No. 4 compactor 504 will be described.

Hereinafter, an embodiment of a case in which the No. 1 alternative switch 611 is set to the plurality of compactors 501, 502, and 503, and the No. 2 alternative switch 612 is set to the plurality of compactors 501, 502, and 504 will be described (see FIG. 14).

In a state in which the No. 1 alternative switch 611 and the No. 2 alternative switch 612 are turned off, or the No. 2 alternative switch 612 is turned on, when the No. 1 alternative switch 611 is turned on, the compactors 501, 502, and 503 set by the No. 1 alternative switch 611 is turned on, and also, the compactor 504 set by only the No. 2 alternative switch 612 is turned off.

That is, in a state in which the No. 2 alternative switch 612 is turned on (the compactors 510, 502, and 504 are turned on), when the No. 1 alternative switch 611 is turned on, the compactor 504 set by only the No. 2 alternative switch 612 is turned off, and also, the compactors 501 and 502, which are commonly set by the Nos. 1 and 2 alternative switches 611 and 612, is maintained in turn-on state.

In a state in which the No. 1 alternative switch 611 and the No. 2 alternative switch 612 are turned off, or the No. 1 alternative switch 611 is turned on, when the No. 2 alternative switch 612 is turned on, the compactors 501, 502, and 504 set by the No. 2 alternative switch 612 is turned on, and also, the compactor 503 set by only the No. 1 alternative switch 611 is turned off.

In this case also, the compactors 501 and 502, which are commonly set by the Nos. 1 and 2 alternative switches 611 and 612, are maintained in turn-on state.

In a state in which the No. 1 alternative switch 611 and the No. 2 alternative switch 612 are turned off, the No. 1 alternative switch 611 is turned on, or the No. 2 alternative switch 612 is turned on, when the No. 1 independent switch 621 is turned on, the No. 3 compactor 503 is turned on, and also, each of other compactors 501, 502, and 504 of the plurality of compactors 500 is maintained in its original state (in turn-on state or turn-off state).

When the No. 1 independent switch 621 is turned on, the No. 3 compactor 503 set by the first independent switch 621 is turned on, and also, each of other compacts 501, 502, and 504 is maintained in its original state (in turn-on state or turn-off state).

When the No. 2 independent switch 622 of the plurality of independent switches 620 is turned on, the No. 4 compactor 504 set by the No. 2 independent switch 622 is turned on, and also, each of other compacts 501, 502, and 503 is maintained in its original state (in turn-on state or turn-off state).

That is, although the present invention is the same as the related art in that combinations of different compactors are selected by selection of the No. 1 alternative switch 611 and the No. 2 alternative switch 612, the compactors may be separately turned on or off regardless of the above-described combination.

Thus, following combinations of the compactors are possible.

When a player selects a combination of the compactors 501, 502, and 503 by the turn-on of the No. 1 alternative switch 611, since the set compactor 503 is separately turned on or off by the turn-on or -off of the No. 1 independent switch 621, and the set compactor 504 is separately turned on or off by the turn-on or -off of the No. 2 independent switch 622, three combinations (501, 502, and 503), (501 and 502) and (501, 502, 503, and 504) may be possible.

When the player selects a combination of the compactors 501, 502, and 504 by the turn-on of the No. 2 alternative switch 612, since the set compactor 503 is separately turned on or off by the turn-on or -off of the No. 1 independent switch 621, and the set compactor 504 is separately turned on or off by the turn-on or -off of the No. 2 independent switch 622, three combinations (501, 502, and 504), (501 and 502) and (501, 502, 503, and 504) may also be possible.

When the player does not select all of the No. 1 alternative switch 611 and the No. 2 alternative switch 612, since the set compactor 503 is separately turned on or off by the turn-on or -off of the No. 1 independent switch 621, and the set compactor 504 is separately turned on or off by the turn-on or -off of the No. 2 independent switch 622, three combinations (503), (504) and (503 and 504) may also be possible.

Except for the duplicated combinations of the above-described combinations, seven combinations may be obtained.

That is, although only one combination of four combinations preset by the four switches is selected in the related art, one of the seven combinations may be selected by the four switches in the present invention. Thus, the number of combinations of the guitar effectors may increase without increasing the number of switches.

However, although a foot motion for selecting one of the four switches is performed in the related art, there is an inconvenience that it is necessary to perform a foot motion for selecting one to three switches of the four switches in the present invention.

However, when considering the fact that there is not a big hindrance to the performance even if there is a little time interval without necessarily pressing the plurality of switches at the same time and the fact that, a player is using a plurality of compactors, the player does not feel the pressure of actually pushing one or three switches.

Hereinabove, the case in which the two alternative switch and one or two independent switches on the basis of four switches are set has been described as an example. However, as long as a plurality of alternative switches and one or more independent switches are set, the above-described effects may be obtained.

That is, all of a case in which three alternative switches and one independent switch on the basis of four switches are set, a case in which three alternative switches and two independent switches on the basis of five switches are set, and a case in which four alternative switches and one independent switch on the basis of five switches are set may be possible.

Also, since something of the above switches is not fixed as an alternative switch, and something else is not fixed as an independent switch, even though the switches are the same, the switches may be used as the alternative switches or the independent switches according to setting of the player.

A unique number is set for each of the combinations and stored in a bank so that the unique numbers are selected and used as needed. Also, the independent switches are preferably marked with different colors or shapes (see FIG. 15).

When the No. 1 independent switch 621 is turned off in the turn-on state of the No. 1 alternative switch 611, the No. 3 compactor 503 may be turned off, and also, each of other compactors 501 and 502 of the plurality of compactors 500 may be maintained in its original state. This case may be preferable for the above effects.

Figure 14:
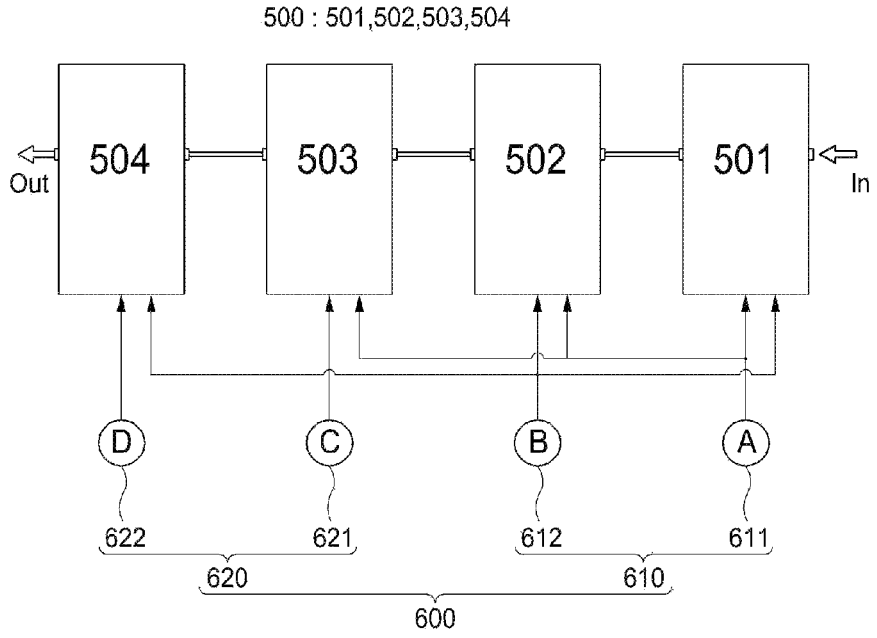
FIG. 14 is a conceptual view of a guitar effector loop according to an embodiment.

As illustrated in FIG. 14, in case in which the No. 2 alternative switch 612 is not set to the No. 3 compactor 503, when the No. 2 alternative switch 612 is turned on in the turn-on state of the No. 1 independent switch 621 and in the turn-off state of the No. 1 alternative switch 611 and the No. 2 alternative switch 612 or in the turn-on state of the No. 1 alternative switch 611 (the turn-on state of the No. 3 compactor 503), the No. 3 compactor 503 may be turned off.

That is, in the state in which only the No. 3 compactor 503 is in the turn-on state (the turn-off state of the No. 1 alternative switch 611 and the No. 2 alternative switch 612), or the Nos. 1, 2, and 3 compactors 501, 502, and 503 are in the turn-on state (the turn-on state of the No. 1 alternative switch 611), the No. 2 alternative switch 612 may be turned on to turn on only the Nos. 1, 2, and 4 compactors 501, 502, and 504 during the performance while the No. 3 compactor 503 is turned off by the turn-on/off of the No. 1 independent switch 621. Thus, a desired combination of the compactors may be quickly selected by the No. 2 alternative switch 612.

Also, in case in which the No. 1 alternative switch 611 is not set to the No. 4 compactor 504, when the No. 1 alternative switch 611 is turned on in the turn-on state of the No. 2 independent switch 622 and in the turn-off state of the No. 1 alternative switch 611 and the No. 2 alternative switch 612 or in the turn-on state of the No. 2 alternative switch 612, the No. 4 compactor 504 may be turned off to obtain the above-described effects.

The No. 1 alternative switch 611 is set to the plurality of compactors 501, 502, and 503 including the No. 1 compactor 501, and when the No. 1 alternative switch 611 is turned off in the turn-on state of the No. 1 alternative switch 611, only the No. 1 compactor 501 may be turned off, and also, each of other compactors 502 and 503 set by the No. 1 alternative switch 611 may be maintained in the turn-on state.

Also, the No. 2 alternative switch 612 is set to the plurality of compactors 502, 502, and 504 including the No. 2 compactor 502, and when the No. 2 alternative switch 612 is turned off in the turn-on state of the No. 2 alternative switch 612, only the No. 2 compactor 502 may be turned off, and also, each of other compactors 502 and 503 set by the No. 2 alternative switch 612 may be maintained in the turn-on state.

Furthermore, when the No. 1 alternative switch 611 is turned on in the turn-off state of the No. 1 alternative switch 611, only the No. 1 compactor 501 may be turned off, and also, each of other compactors 502 and 503 set by the No. 1 alternative switch 611 may be maintained in the turn-on state. When the No. 2 alternative switch 612 is turned on in the turn-off state of the No. 2 alternative switch 612, only the No. 2 compactor 502 may be turned on, and also, each of other compactors 501 and 504 set by the No. 2 alternative switch 612 may be maintained in the turn-on state.

That is, the No. 1 alternative switch 611 and the No. 2 alternative switch 612 may fundamentally selectively (alternatively) operate. Here, when the No. 1 alternative switch 611 is pushed again in the turn-on state of the No. 1 alternative switch 611, the No. 1 compactor 501 is turned off as if the No. 1 compactor 501 is the independent switching. Also, when the No. 2 alternative switch 612 is pushed in the turn-on state of the No. 2 alternative switch 612, the No. 2 compactor 502 may be turned off as if the No. 2 compactor 502 is the independent switch. Thus, more various combinations may be obtained.

In the guitar effector loop according to the related art, one of the plurality of alternative switches is pushed to be selected (turned on) only, and there is no function that pushes the selected alternative switch again to turn off.

However, the above-described embodiment has features in which the alternative switch is pushed to turn off in the turn-on state of the alternative switch, and also, only one preset compactor is turned off, but all of the plurality of compactors, which are set by the corresponding alternative switch, are turned off when turned off.

Thus, following combinations of the compactors may be obtained.

When the player selects a combination of the compactors 501, 502, and 503 by the turn-on of the No. 1 alternative switch 611, since the set compactor 503 is separately turned on or off by the turn-on or -off of the No. 1 independent switch 621, the set compactor 504 is separately turned on or off by the turn-on or off of the No. 2 independent switch 622, and only the preset one compactor 501 is turned of by the turn-off of the No. 1 alternative switch 611, six combinations may be possible.

(501, 502, and 503), (501 and 502), (501, 502, 503, and 504), (502 and 503), (502), and (502, 503, and 504)

When the player selects a combination of the compactors 502, 502, and 504 by the turn-on of the No. 2 alternative switch 612, since the set compactor 503 is separately turned on or off by the turn-on or -off of the No. 1 independent switch 621, the set compactor 504 is separately turned on or off by the turn-on or off of the No. 2 independent switch 622, and only the preset one compactor 502 is turned of by the turn-off of the No. 1 alternative switch 612, six combinations may be possible.

(501, 502, and 504), (501 and 502), (501, 502, 503, and 504), (501 and 504), (501), and (501, 503, and 504)

As described above, when the player does not select all of the No. 1 alternative switch 611 and the No. 2 alternative switch 612, since the set compactor 503 is separately turned on or off by the turn-on or -off of the No. 1 independent switch 621, and the set compactor 504 is separately turned on or off by the turn-on or -off of the No. 2 independent switch 622, three combinations (503), (504) and (503 and 504) may also be possible.

Except for the duplicated combinations of the above-described combinations, thirteen combinations may be obtained.

That is, although only one combination of four combinations preset by the four switches is selected in the related art, one of the thirteen combinations may be selected by the four switches in the present invention. Thus, the number of combinations of the guitar effectors may increase without increasing the number of switches.

In the above-described embodiment, the No. 1 alternative switch 611 is set to the No. 1 compactor 501 (when the switch is pushed, the compactor is turned on), and the No. 2 alternative switch 612 is set to the No. 2 compactor 502. On the other hand, although the No. 1 alternative switch 611 is not set to the No. 1 compactor 501, or the No. 2 alternative switch 612 is not set to the No. 2 compactor 502, the above-described effects may be obtained (see FIGS. 16 and 17).

That is, the No. 1 alternative switch 611 is set to the plurality of compactors 502 and 503, which do not include the No. 1 compactor 501, and when the No. 1 alternative switch 611 is turned off in the turn-on state of the No. 1 alternative switch 611, the compactor 502 and 503 set by the No. 1 alternative switch 611 may be maintained in the turn-on state, and also, the No. 1 compactor 501 may be turned on.

The No. 2 alternative switch 612 is set to the plurality of compactors 502 and 503, which do not include the No. 1 compactor 502, and when the No. 2 alternative switch 612 is turned off in the turn-on state of the No. 2 alternative switch 612, the compactor 501 and 504 set by the No. 2 alternative switch 612 may be maintained in the turn-on state, and also, the No. 2 compactor 502 may be turned on.

Furthermore, when the No. 1 alternative switch 611 is turned on in the turn-off state of the No. 1 alternative switch 611, only the No. 1 compactor 501 may be turned off, and also, each of other compactors 502 and 503 set by the No. 1 alternative switch 611 may be maintained in the turn-on state. When the No. 2 alternative switch 612 is turned on in the turn-off state of the No. 2 alternative switch 612, only the No. 2 compactor 502 may be turned on, and also, each of other compactors 501 and 504 set by the No. 2 alternative switch 612 may be maintained in the turn-on state.

In this embodiment, although the turn-on/off of the No. 1 compactor 501 by the No. 1 alternative switch 611 and the turn-on/off of the No. 2 compactor 502 by the No. 2 alternative switch 612 reversely operate with respect to each other, the same function and effect as those of the above-mentioned embodiment may be substantially realized.

That is, the No. 1 alternative switch 611 and the No. 2 alternative switch 612 may fundamentally selectively (alternatively) operate. Here, when the No. 1 alternative switch 611 is pushed again in the turn-on state of the No. 1 alternative switch 611, the No. 1 compactor 501 is turned off as if the No. 1 compactor 501 is the independent switching. Also, when the No. 2 alternative switch 612 is pushed in the turn-on state of the No. 2 alternative switch 612, the No. 2 compactor 502 may be turned off as if the No. 2 compactor 502 is the independent switch. Thus, more various combinations may be obtained.

As illustrated in FIG. 14, when the No. 2 alternative switch 612 is not set to the No. 3 compactor 503, the No. 2 alternative switch 612 is turned off in the turn-on state of the No. 1 alternative switch 611 and the No. 2 alternative switch 612 (the turn-on state of the compactors 501 to 504), only the No. 3 compactor 503 may be turned off, and also, each of other compactors 501, 502, and 503 set by the No. 2 alternative switch 612 may be maintained in the turn-on state.

That is, in the state in which the Nos. 1, 2, 3, and 4 compactor 501, 502, 503, and 504 are in the turn-on state (the turn-off state of the No. 2 alternative switch 612 and the No. 1 alternative switch 611), the No. 2 alternative switch 612 may be turned on to turn on only the Nos. 1, 2, and 4 compactors 501, 502, and 504 during the performance while the No. 3 compactor 503 is turned off by the turn-on/off of the No. 1 independent switch 621. Thus, a desired combination of the compactors may be quickly selected by the No. 2 alternative switch 612.

Hereinafter, a multi-type guitar effector according to the present invention will be described with reference to FIGS. 18 to 22.

A multi-type guitar effector according to the present invention has a fundamental feature in which a plurality of guitar effector modules 100 are detachably installed in a body 210, wherein different kinds of plurality of guitar effector modules 100 (corresponding to the compactors according to the foregoing embodiments) are installed, and the above-described guitar effector loop function is given.

Figure 16:
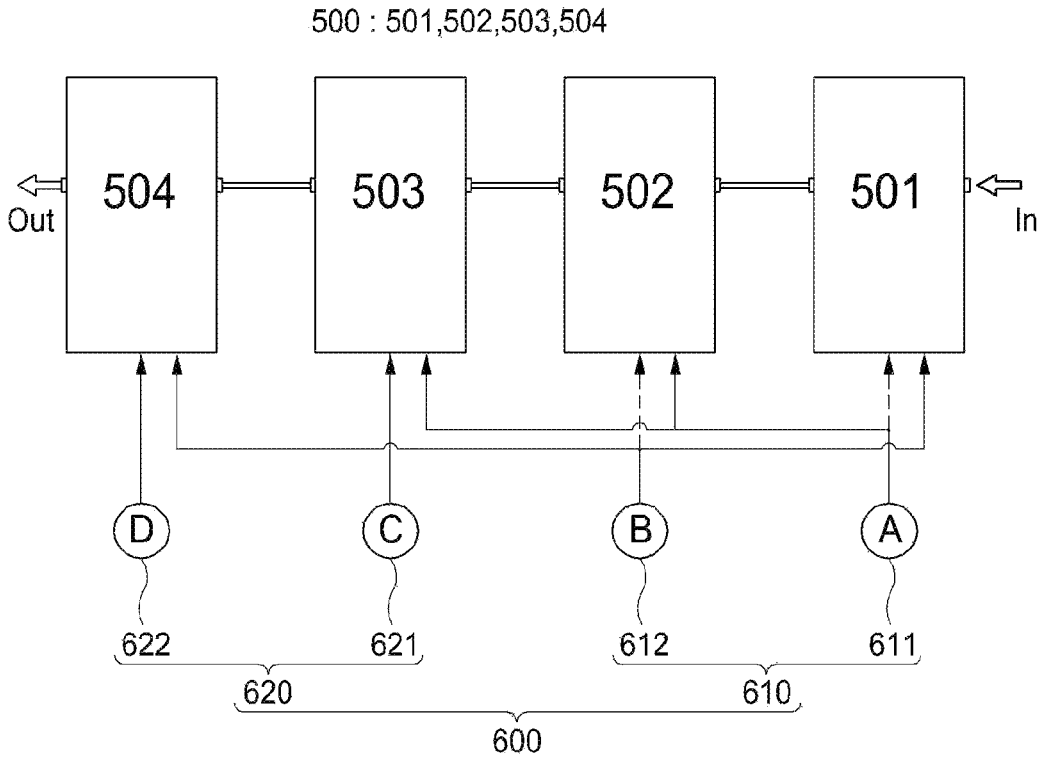
FIG. 16 is a conceptual view of a guitar effector loop according to another embodiment.

Each of the guitar effector modules 100 includes: a component circuit board 110 on which a circuit for an analogue type guitar effector is disposed; a module case 130 on which a variable resistor driving unit 131 for adjusting a sound by the circuit is mounted and in which the component circuit board 110 is installed; and a circuit connection unit 120 in which a circuit unit part 121, a circuit output part 122, and a circuit power supply part 123 with respect to the circuit are disposed and which is electrically connected to the component circuit board 110 and is installed outside the module case 130 (see FIG. 16).

Figure 18:
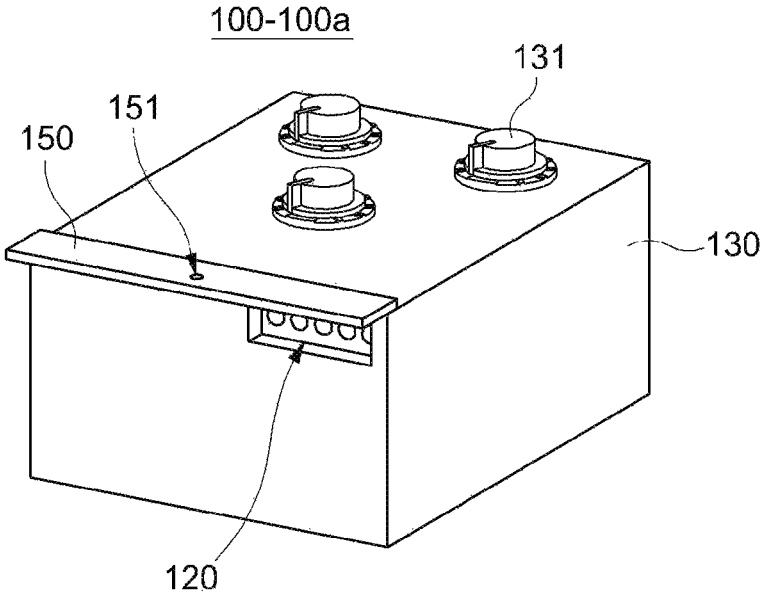
FIG. 18 is a perspective view of a guitar effector module.
Figure 19:
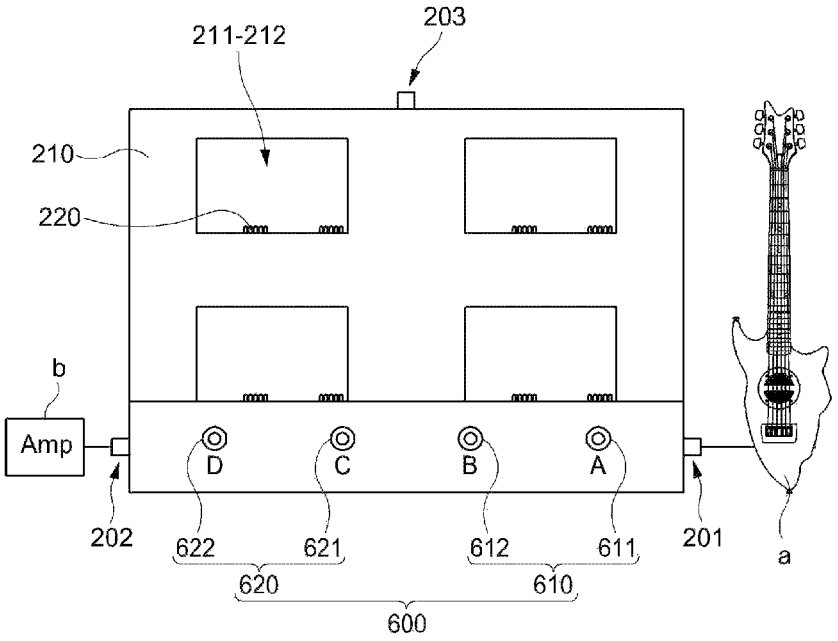
FIG. 19 is a plan view illustrating a first usage state of a multi-type guitar effector.
Figure 20:
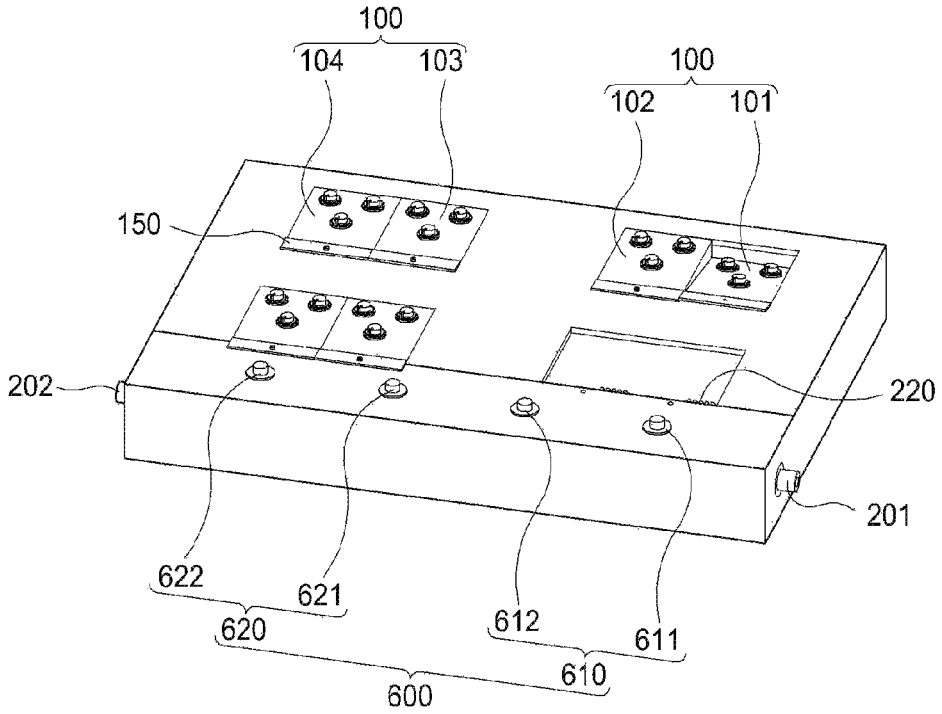
FIG. 20 is a perspective view illustrating a second use state of the multi-type guitar effector.
Figure 21:
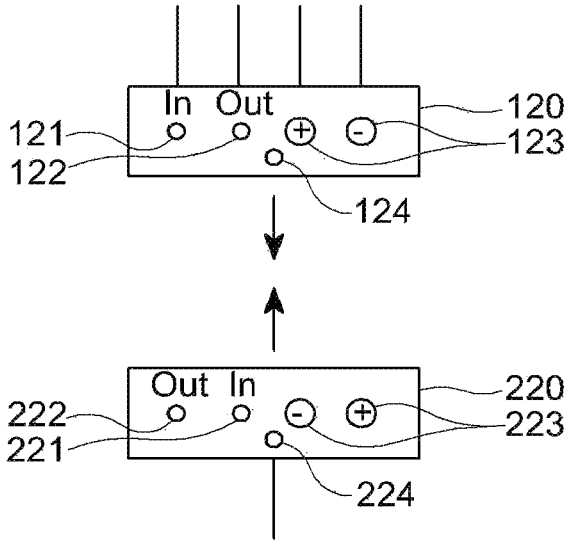
FIG. 21 is an exploded perspective view of the multi-type guitar effector.

The multi-type guitar effector on which the plurality of guitar effector modules 100 are mounted includes: the body having a module mounting space 211 for mounting the plurality of guitar effector modules 100 therein; a plurality of opened parts 212 defined in a top surface of the body 210 having a shape corresponding to one or a plurality of module cases 130 so that the plurality of module cases 130 are installed; a plurality of body connection units 220 in which body input parts 221, body output parts 222, and body power supply parts 223 are disposed to be connected to the circuit input parts 121, the circuit output parts 122, and the circuit power supply parts 123 of the plurality of circuit connection units 120, respectively; a body circuit board 230 which is connected to the plurality of body connection parts 220 and mounted on a body circuit mounting space 213 of the body 210 and in which a body circuit is disposed; an input terminal 201 disposed in the body 210 to receive an input signal of a guitar a and connected to the body circuit; an output terminal 202 disposed in the body 210 to transmit an output signal to an amplifier b and connected to the body circuit; and a plurality of foot switches 600 which is installed on the body 210 or a separate device connected to the body 210 so that various combinations of the guitar effector modules 110 are obtained by turning on/off one or the plurality of guitar effector modules 100 according to setting about the body circuit and which is connected to the body circuit (see FIGS. 18 and 19).

Here, the body circuit performs a control so that the input signal received through the input terminal 201 is distorted by sequentially passing through the plurality of component circuits to output the distorted signal through the output terminal 202.

As described above, the multi-type guitar effector according to the present invention may have the function of the above-described guitar effector loop as it is.

That is, the plurality of guitar effector modules 100 include a No. 1 guitar effector module 101, a No. 2 guitar effector module 102, and a No. 3 guitar effector module 103. The plurality of foot switches 600 include a plurality of alternative switches 610 including a No. 1 alternative switch 611 and a No. 2 alternative switch 612 and an independent switch 620. The No. 1 alternative switch 611 is set to the plurality of guitar effector modules 100, and the No. 2 alternative switch 612 is set to the plurality of guitar effector modules 100 so that combinations different from the combinations of the plurality of guitar effector modules 100, which are set by the No. 1 alternative switch 611, are obtained. Also, the independent switch 620 is set to the No. 3 guitar effector module 103.

In a state in which the No. 1 alternative switch 611 and the No. 2 alternative switch 612 are turned off, or the No. 2 alternative switch 612 is turned on, when the No. 1 alternative switch 611 is turned on, the guitar effector module 100 set by the No. 1 alternative switch 611 is turned on, and also, the guitar effector module 100 set by only the No. 2 alternative switch 612 is turned off.

In a state in which the No. 1 alternative switch 611 and the No. 2 alternative switch 612 are turned off, or the No. 1 alternative switch 611 is turned on, when the No. 2 alternative switch 612 is turned on, the guitar effector module 100 set by the No. 2 alternative switch 612 is turned on, and also, the guitar effector module 100 set by only the No. 1 alternative switch 611 is turned off.

In a state in which the No. 1 alternative switch 611 and the No. 2 alternative switch 612 are turned off, the No. 1 alternative switch 611 is turned on, or the No. 2 alternative switch 612 is turned on, when the No. 1 independent switch 621 is turned on, the No. 3 guitar effector module 103 is turned on, and also, each of other guitar effector modules 100 of the plurality of guitar effector modules 100 is maintained in its original state.

The effects of these constituents are the same as that of the embodiment of the above-described guitar effector loop.

Also, specific embodiments about the above-described guitar effect loop may be applied to the embodiment of the multi-type guitar effector as it is, and the above-described functions and effects may be obtained also in this case.

When the No. 1 independent switch 621 is turned off in the turn-on state of the No. 1 alternative switch 611, the No. 3 guitar effector module 103 may be turned off, and also, each of other guitar effector modules 101 and 102 of the plurality of guitar effector modules 100 may be maintained in its original state. This case may be preferable for the above effects.

In case in which the No. 1 alternative switch 611 is not set to the No. 3 guitar effector module 103, when the No. 1 alternative switch 611 is turned on in the turn-on state of the No. 1 independent switch 621 and in the turn-off state of the No. 1 alternative switch 611 and the No. 2 alternative switch 612 or in the turn-off state of No. 2 alternative switch 612, the No. 3 guitar effector module 103 may be turned off to quickly select a desired combination of the effector modules.

In case in which the No. 2 alternative switch 612 is not set to the No. 3 guitar effector module 103, when the No. 2 alternative switch 612 is turned on in the turn-on state of the No. 1 independent switch 621 and in the turn-off state of the No. 1 alternative switch 611 and the No. 2 alternative switch 612 or in the turn-on state of the No. 1 alternative switch 611, even though the No. 3 guitar effector module 103 is turned off, the above effects may be obtained.

The No. 1 alternative switch 611 is set to the plurality of guitar effector modules 100 including the No. 1 guitar effector module 101, and when the No. 1 alternative switch 611 is turned off in the turn-on state of the No. 1 alternative switch 611, only the No. 1 guitar effector module 101 may be turned off, and also, each of other guitar effector modules 100 set by the No. 1 alternative switch 611 may be maintained in the turn-on state.

The No. 2 alternative switch 612 is set to the plurality of guitar effector modules 102 including the No. 2 guitar effector module 102, and when the No. 2 alternative switch 612 is turned off in the turn-on state of the No. 2 alternative switch 612, only the No. 2 guitar effector module 102 may be turned off, and also, each of other guitar effector modules 100 set by the No. 2 alternative switch 612 may be maintained in the turn-on state.

When the No. 1 alternative switch 611 is turned on in the turn-off state of the No. 1 alternative switch 611, only the No. 1 guitar effector module 101 may be turned off, and also, each of other guitar effector modules 100 set by the No. 1 alternative switch 611 may be maintained in the turn-on state. When the No. 2 alternative switch 612 is turned on in the turn-off state of the No. 2 alternative switch 612, only the No. 2 guitar effector module 102 may be turned on, and also, each of other guitar effector modules 100 set by the No. 2 alternative switch 612 may be maintained in the turn-on state.

As described above, this has the effect that a variety of guitar effector modules are capable of being combined by selecting the switches.

The No. 1 alternative switch 611 is set to the plurality of guitar effector modules 100 which does not include the No. 1 guitar effector module 101, and when the No. 1 alternative switch 611 is turned off in the turn-on state of the No. 1 alternative switch 611, the guitar effector module 100 set by the No. 1 alternative switch 611 may be maintained in the turn-on state, and also, the No. 1 guitar effector module 101 may be turned on.

The No. 2 alternative switch 612 is set to the plurality of guitar effector modules 100 which does not include the No. 2 guitar effector module 102, and when the No. 2 alternative switch 612 is turned off in the turn-on state of the No. 2 alternative switch 612, the guitar effector module 100 set by the No. 2 alternative switch 612 may be maintained in the turn-on state, and also, the No. 2 guitar effector module 102 may be turned on.

When the No. 1 alternative switch 611 is turned on in the turn-off state of the No. 1 alternative switch 611, only the No. 1 guitar effector module 101 may be turned off, and also, each of other guitar effector modules 100 set by the No. 1 alternative switch 611 may be maintained in the turn-on state. When the No. 2 alternative switch 612 is turned on in the turn-off state of the No. 2 alternative switch 612, only the No. 2 guitar effector module 102 may be turned off, and also, each of other guitar effector modules 100 set by the No. 2 alternative switch 612 may be maintained in the turn-on state.

As described above, this also has the effect that a variety of guitar effector modules are capable of being combined by selecting the switches.

In case in which the No. 1 alternative switch 611 is not set to the No. 3 guitar effector module 103, when the No. 1 alternative switch 611 is turned off in the turn-on state of the No. 1 alternative switch 611 and the No. 1 independent switch 621, only the No. 3 guitar effector module 103 may be turned off, and also, each of other guitar effector modules 100 set by the No. 1 alternative switch 611 may be maintained in the turn-on state.

In case in which the No. 2 alternative switch 612 is not set to the No. 3 guitar effector module 103, when the No. 2 alternative switch 612 is turned off in the turn-on state of the No. 1 alternative switch 611 and the No. 2 independent switch 612, only the No. 3 guitar effector module 103 may be turned off, and also, each of other guitar effector modules 100 set by the No. 2 alternative switch 612 may be maintained in the turn-on state.

As described above, this has the advantage that the alternative switch 610 is capable of quickly selecting a desired combination of the effector modules.

Embodiments and effects with respect to the plurality of switches 600 may be fundamentally the same as those of the above-described guitar effector loop, and thus, specific constituents and effects of the multi-type guitar effector will be described below.

The body circuit performs a control such that the input signal received through the input terminal 201 is transferred to the circuit input parts 121 of the plurality of circuit connection units 120 through the body output parts 222 of the plurality of body connection units 220, and the signal distorted by the plurality of component circuits is transferred to the body input parts 221 of the plurality of body connection units 220 through the circuit output parts 122 of the plurality of circuit connection units 120 and then is output through the output terminal 202.

Since it is preferred that a signal ground (signal GND) is separately connected to remove noise, signal GND connection parts 124 of the circuit connection units 120 are separately connected to signal GND connection parts 224 of the body connection parts 220.

For example, the input signal received through the input terminal 201 is transferred to the circuit input part 121 of the circuit connection unit 120 of the No. 1 guitar effector module 101 through the body output part 222 of the No. 1 body connection unit 220 of the body 210, and the signal distorted by the circuit of the No. 1 guitar effector module 101 is transferred to the body input part 221 of the No. 1 body connection unit 220 through the circuit output part 122 of the circuit connection unit 120, and then is transferred to the body circuit again.

The signal of the body circuit is transferred to the circuit input part 121 of the circuit connection unit 120 of the No. 2 guitar effector module 100 through the body output part 222 of the No. 2 body connection unit 220 of the body 210, and the signal distorted by the circuit of the No. 2 guitar effector module 102 is transferred to the body input part 221 of the No. 2 body connection unit 220 through the circuit output part 122 of the circuit connection unit 120, and then is transferred to the body circuit again.

The signal distorted by the circuit of the final guitar effector module 100 through this process is transferred to the body input part 221 of the final body connection unit 220 through the circuit output part 122 of the circuit connection unit 120 of the final guitar effector module 100 and then is output through the output terminal 202.

That is, the multi-type guitar effector according to the present disclosure is not configured by the plurality of compactors which are separate complete products and a multi-type apparatus (loop) as in the related art, but a complete product thereof is finally obtained by coupling the plurality of guitar effector modules 100 to the body 210 of the multi-type guitar effector.

When this configuration is selected, a combination structure in which a plurality of circuits for the guitar effectors are mutually coupled to each other may be achieved only by mounting the guitar effector modules 100 on the body 210 and connecting the circuit connection units 120 thereof to the body connection units 220 of the body 210. Thus, use of a plurality of cables as in the related art may be omitted, so that transport, storage, installation and use thereof are simple and convenient.

The variable resistor driving unit 131 for adjusting a level, a tone, and the like may be mounted on the module case 130, and the module case 130 is coupled to the opened part 212 of the body. Therefore, the effector circuit of the corresponding component assembly may be adjusted by the above-described variable resistor driving part 131.

A catching part 150 that protrudes outward from an upper portion of the module case 130 and is stepped upward is disposed on the module case 130. While a top surface of the guitar effector module 100 having such a structure is exposed to the above opened part 212 through a lower opened portion of the body 210, when the catching part 150 is caught by an edge of the opened part 212 of the body 210, and the lower opened portion of the body 210 is coupled (screw-coupled or the like) through a separate closed plate 250, simple, convenient, and stable coupling may be achieved (see FIG. 22).

When a coupling hole 151 is defined in the catching part 150, and a screw member or the like is coupled to the body 210 through the coupling hole 151, more stable coupling may be achieved.

The opened part 212 of the body 210 has a shape corresponding to one or the plurality of module cases 130. When the opened part 212 has the shape corresponding to the plurality of module cases 130, a plurality of small guitar effector modules 100*a* may be installed in one opened part 212 (see FIG. 19).

Figure 22:
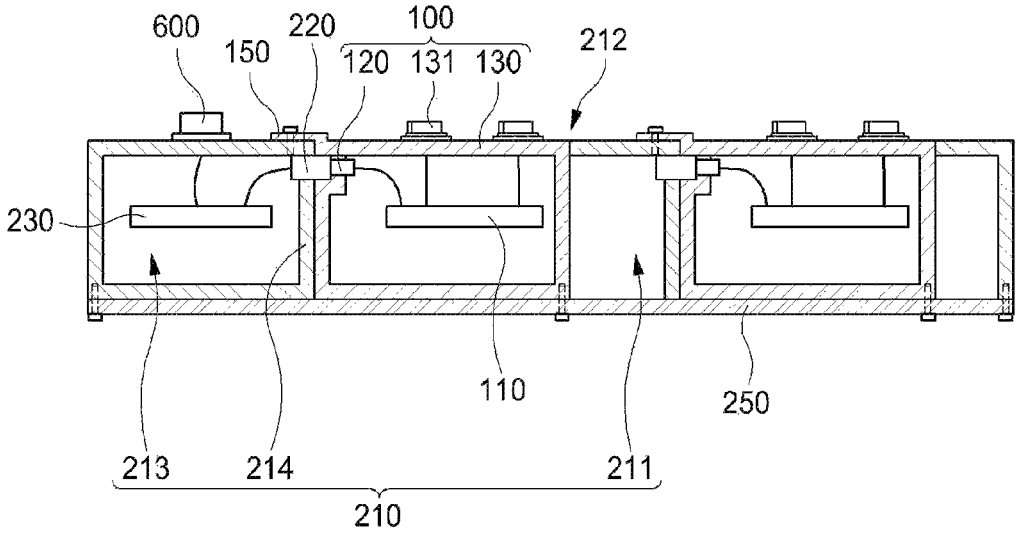
FIG. 22 is a cross-sectional view of the multi-type guitar effector.

It is preferred for stable mounting of the guitar effector modules 100 that the body connection units 220 of the body 210 of the multi-type guitar effector protrude from lower sides of the opened parts 212, and the circuit connection units 120 of the guitar effector modules 100 are recessed to correspond thereto (see FIG. 22).

The circuit input part 121 for transferring an input signal to the circuit, the circuit output part 122 for outputting an output signal distorted by the circuit, and the circuit power supply part 123 for supplying power to the circuit are disposed in the circuit connection unit 120 of the guitar effector module 100.

The body input part 221 for receiving the output signal from the circuit output part 122, the body output part 222 for transmitting a signal of the body circuit to the circuit input part 121 of the guitar effector module 100, and the body power supply part 223 for supplying power to the circuit power supply part 123 are disposed in the body connection unit 220 that is connected to the circuit connection unit 120 (see FIG. 19).

The circuit connection unit 120 of the guitar effector module 100 and the body connection part 220 of the body 210 may be fitted in each other by uneven structures. When a coupling structure in which the top surface of the guitar effector module 100 is exposed through the opened part 212 as described above is selected, a groove structure is selected as the circuit connection unit 120 of the guitar effector module 100, and a protruding structure is selected as the body connection unit 220 of the body 210, so that the coupling between the body 210 and the guitar effector module 100 and the coupling between the circuit connection unit 120 and the body connection unit 220 may be naturally achieved together.

The body 210 is spatially partitioned by a partition wall 214. The body circuit board 230 is mounted in the body circuit mounting space 213 of the partitioned spaces, and the guitar effector module 100 is mounted in the module mounting space 211 on an opposite side thereto.

The body connection unit 220 connected to the body circuit board 230 is exposed close to the module mounting space 211 over the partition wall 214, and the plurality of guitar effector modules 100 are coupled to each other in such a module mounting space 211.

Thus, a user may obtain a multi-type guitar effector having a desired combination only by coupling the plurality of guitar effector modules 100 to the body 210 in a desired pattern, and accordingly, the coupling the circuit connection unit 120 and the body connection unit 220 in the module mounting space 211.

The input terminal 201 that is connected to the body circuit to receive the input signal from the guitar a and the output terminal 202 that is connected to the body circuit to transmit the output signal to the amplifier b are disposed at one side or opposite sides of the body 210, and the plurality of switches 240 that are connected to the body circuit to turn on/off the component circuit board 110 are installed to be exposed to the top surface of the body 210.

Here, the switch 600 may have the same function as the switch 600 of the above-described effector loop.

The power supply terminal 203 is installed in the body 210. Power supplied to the power supply terminal 203 is supplied to the plurality of component circuit boards 110 through the body power supply parts 223 of the plurality of body connection units 220 and the circuit power supply parts 123 of the plurality of circuit connection parts 120.

As described above, the body circuit serves to output a signal that is input through one of the plurality of body connection parts 220, through a subsequent body connection unit 220, and output a signal that is distorted by repeating this process to the output terminal.

The present invention may provide the guitar effector loop that is capable of increasing the number of combinations of the guitar effectors without increasing the number of switches and the multi-type guitar effector using the same.

Although the above description merely corresponds to some exemplary embodiments that may be implemented by the present disclosure, as well known, the scope of the present disclosure should not be interpreted as being limited to the above-described embodiments, and all technical spirits having the same basis as that of the above-described technical spirit of the present disclosure are included in the scope of the present disclosure.

What is claimed is:

1. A guitar effector loop comprising foot switches (600) which are connected to a guitar (a), an amplifier (b), and a plurality of compactors (500) and set to turn on/off one or more compactors (500) of the plurality of compactors (500) according to setting of a control unit of a body, wherein the plurality of foot switches (600) are installed in the body so that various combinations of the plurality of compactors (500) are obtained, wherein the plurality of compactors (500) comprise a No. 1 compactor (501), a No. 2 compactor (502), and a No. 3 compactor (503), the plurality of foot switches (600) comprise a plurality of alternative switches (610) comprising a No. 1 alternative switch (611) and a No. 2 alternative switch (612) and an independent switch (620), the No. 1 alternative switch (611) is set to the plurality of compactors (500), the No. 2 alternative switch (612) is set to the plurality of compactors (500) so that combinations different from the combinations of the plurality of compactors (500), which are set by the No. 1 alternative switch (611), are obtained, the independent switch (620) is set to the No. 3 compactor (503), in a state in which the No. 1 alternative switch (611) and the No. 2 alternative switch (612) are turned off, or the No. 2 alternative switch (612) is turned on, when the No. 1 alternative switch (611) is turned on, the compactor (500) set by the No. 1 alternative switch (611) is turned on, and the compactor (504) set by only the No. 2 alternative switch (612) is turned off, in a state in which the No. 1 alternative switch (611) and the No. 2 alternative switch (612) are turned off, or the No. 1 alternative switch (611) is turned on, when the No. 2 alternative switch (612) is turned on, the compactor (500) set by the No. 2 alternative switch (612) is turned on, and the compactor (500) set by only the No. 1 alternative switch (611) is turned off, and In a state in which the No. 1 alternative switch (611) and the No. 2 alternative switch (612) are turned off, the No. 1 alternative switch (611) is turned on, or the No. 2 alternative switch (612) is turned on, when the No. 1 independent switch (621) is turned on, the No. 3 compactor (503) is turned on, and also, each of other compactors (500) of the plurality of compactors (500) is maintained in its original state.

2. The guitar effector loop of claim 1, wherein, when the independent switch (620) is turned off in the turn-on state of the independent switch (620), the No. 3 compactor (503) is turned off, and each of other compactors (501, 502) of the plurality of compactors (500) is maintained in its original state.

3. The guitar effector loop of claim 2, wherein, in case in which the No. 2 alternative switch (612) is not set to the No. 3 compactor (503), when the No. 2 alternative switch (612) is turned on in the turn-on state of the independent switch (620) and in the turn-off state of the No. 1 alternative switch (611) and the No. 2 alternative switch (612) or in the turn-on state of the No. 1 alternative switch (611), the No. 3 compactor (503) is turned off.

4. The guitar effector loop of claim 1, wherein the No. 1 alternative switch (611) is set to the plurality of compactors (500) comprising the No. 1 compactor (501), and when the No. 1 alternative switch (611) is turned off in the turn-on state of the No. 1 alternative switch (611), only the No. 1 compactor (501) is turned off, and the other compactor (500) set by the No. 1 alternative switch (611) is maintained in the turn-on state.

5. The guitar effector loop of claim 4, wherein, when the No. 1 alternative switch (611) is turned on in the turn-off state of the No. 1 alternative switch (611), only the No. 1 compactor (501) is turned on, and the other compactor (500) set by the No. 1 alternative switch (611) is maintained in the turn-on state.

6. The guitar effector loop of claim 1, wherein the No. 1 alternative switch (611) is set to the plurality of compactors (500) not comprising the No. 1 compactor (501), and when the No. 1 alternative switch (611) is turned off in the turn-on state of the No. 1 alternative switch (611), the compactor (500) set by the No. 1 alternative switch (611) is maintained in the turn-on state, and the No. 1 compactor (501) is turned on.

7. The guitar effector loop of claim 6, wherein, when the No. 1 alternative switch (611) is turned on in the turn-off state of the No. 1 alternative switch (611), only the No. 1 compactor (501) is turned off, and the other compactor (500) set by the No. 1 alternative switch (611) is maintained in the turn-on state.

8. The guitar effector loop of claim 1, wherein, in case in which the No. 2 alternative switch (612) is not set to the No. 3 compactor (503), when the No. 2 alternative switch (612) is turned off in the turn-on state of the No. 2 alternative switch (612) and the independent switch (620), only the No. 3 compactor (503) is turned off, and the other compactor (500) set by the No. 2 alternative switch (612) is maintained in the turn-on.

9. A multi-type guitar effector, in which a plurality of guitar effector modules (100) are installed, wherein each of the guitar effector modules (100) comprises a component circuit board (110) on which a circuit for an analogue type guitar effector is disposed; a module case (130) on which a variable resistor driving unit (131) for adjusting a sound by the circuit is mounted and in which the component circuit board (110) is installed; and a circuit connection unit (120) in which a circuit unit part (121), a circuit output part (122), and a circuit power supply part (123) with respect to the circuit are disposed and which is electrically connected to the component circuit board (110) and is installed outside the module case (130), the multi-type guitar effector comprising:

a body having a module mounting space (211) for mounting the plurality of guitar effector modules (100) therein;

a plurality of opened parts (212) defined in a top surface of the body (210) having a shape corresponding to one or a plurality of module cases (130) so that the plurality of module cases (130) are installed;

a plurality of body connection units (220) in which body input parts (221), body output parts (222), and body power supply parts (223) are disposed to be connected to the circuit input parts (121), the circuit output parts (122), and circuit power supply parts (123) of the plurality of circuit connection units (120), respectively;

a body circuit board (230) which is connected to the plurality of body connection parts (220) and mounted on a body circuit mounting space (213) of the body (210) and in which a body circuit is disposed;

an input terminal (201) disposed in the body (210) to receive an input signal of a guitar (a) and connected to the body circuit;

an output terminal (202) disposed in the body (210) to transmit an output signal to an amplifier (b) and connected to the body circuit; and a plurality of foot switches (600) which is installed on the body (210) or a separate device connected to the body (210) so that various combinations of the guitar effector modules (110) are obtained by turning on/off one or the plurality of guitar effector modules (100) according to setting about the body circuit and which is connected to the body circuit, wherein the body circuit performs a control so that the input signal received through the input terminal (201) is distorted by sequentially passing through the plurality of component circuits to output the distorted signal through the output terminal (202), the plurality of guitar effector modules (100) comprise a No. 1 guitar effector module (101), a No. 2 guitar effector module (102), and a No. 3 guitar effector module (103), the plurality of foot switches (600) comprise a plurality of alternative switches (610) comprising a No. 1 alternative switch (611) and a No. 2 alternative switch (612) and an independent switch (620), the No. 1 alternative switch (611) is set to the plurality of guitar effector modules (100), the No. 2 alternative switch (612) is set to the plurality of guitar effector modules (100) so that combinations different from the combinations of the plurality of guitar effector modules (100), which are set by the No. 1 alternative switch (611), are obtained, the independent switch (620) is set to the No. 3 guitar effector module (103), in a state in which the No. 1 alternative switch (611) and the No. 2 alternative switch (612) are turned off, or the No. 2 alternative switch (612) is turned on, when the No. 1 alternative switch (611) is turned on, the guitar effector module (100) set by the No. 1 alternative switch (611) is turned on, and the guitar effector module (100) set by only the No. 2 alternative switch (612) is turned off, in a state in which the No. 1 alternative switch (611) and the No. 2 alternative switch (612) are turned off, or the No. 1 alternative switch (611) is turned on, when the No. 2 alternative switch (612) is turned on, the guitar effector module (100) set by the No. 2 alternative switch (612) is turned on, and the guitar effector module (100) set by only the No. 1 alternative switch (611) is turned off, and in a state in which the No. 1 alternative switch (611) and the No. 2 alternative switch (612) are turned off, the No. 1 alternative switch (611) is turned on, or the No. 2 alternative switch (612) is turned on, when the No. 1 independent switch (621) is turned on, the No. 3 guitar effector module (103) is turned on, and each of other guitar effector modules (100) of the plurality of guitar effector modules (100) is maintained in its original state.

10. The multi-type guitar effector of claim 9, wherein, when the independent switch (620) is turned off in the turn-on state of the independent switch (620), the No. 3 compactor (503) is turned off, and each of other guitar effector modules (101, 102) of the plurality of guitar effector modules (100) is maintained in its original state.

11. The multi-type guitar effector of claim 10, wherein, in case in which the No. 2 alternative switch (612) is not set to the No. 3 guitar effector module (103), when the No. 2 alternative switch (612) is turned on in the turn-on state of the independent switch (620) and in the turn-off state of the No. 1 alternative switch (611) and the No. 2 alternative switch (612) or in the turn-on state of the No. 1 alternative switch (611), the No. 3 guitar effector module (103) is turned off.

12. The multi-type guitar effector of claim 9, wherein the No. 1 alternative switch (611) is set to the plurality of guitar effector modules (100) comprising the No. 1 guitar effector module (101), and when the No. 1 alternative switch (611) is turned off in the turn-on state of the No. 1 alternative switch (611), only the No. 1 guitar effector module (101) is turned off, and the other guitar effector module (100) set by the No. 1 alternative switch (611) is maintained in the turn-on state.

13. The multi-type guitar effector of claim 12, wherein, when the No. 1 alternative switch (611) is turned on in the turn-off state of the No. 1 alternative switch (611), only the No. 1 guitar effector module (101) is turned on, and the other guitar effector module (100) set by the No. 1 alternative switch (611) is maintained in the turn-on state.

14. The multi-type guitar effector of claim 9, wherein the No. 1 alternative switch (611) is set to the plurality of guitar effector modules (100) not comprising the No. 1 guitar effector module (101), and when the No. 1 alternative switch (611) is turned off in the turn-on state of the No. 1 alternative switch (611), the guitar effector module (100) set by the No. 1 alternative switch (611) is maintained in the turn-on state, and the No. 1 guitar effector module (101) is turned on.

15. The multi-type guitar effector of claim 14, wherein, when the No. 1 alternative switch (611) is turned on in the turn-off state of the No. 1 alternative switch (611), only the No. 1 guitar effector module (101) is turned off, and the other guitar effector module (100) set by the No. 1 alternative switch (611) is maintained in the turn-on state.

16. The multi-type guitar effector of claim 9, wherein, in case in which the No. 2 alternative switch (612) is not set to the No. 3 guitar effector module (103), when the No. 2 alternative switch (612) is turned off in the turn-on state of the No. 2 alternative switch (612) and the independent switch (620), only the No. 3 guitar effector module (103) is turned off, and the other guitar effector module (100) set by the No. 2 alternative switch (612) is maintained in the turn-on.

* * * * *